United States Patent [19]

Evans

[11] 4,008,571

[45] Feb. 22, 1977

[54] HYDRAULIC SYSTEM FOR ELECTRIC LIFT TRUCKS

[75] Inventor: Dafydd Williams Evans, Euclid, Ohio

[73] Assignee: Towmotor Corporation, Mentor, Ohio

[22] Filed: Mar. 31, 1976

[21] Appl. No.: 672,371

[52] U.S. Cl. ..... 60/423; 60/468; 60/486; 60/DIG. 2

[51] Int. Cl.[2] ..... F15B 13/09

[58] Field of Search ..... 60/423, 468, 486, DIG. 2, 60/430

[56] References Cited

UNITED STATES PATENTS

| | | | |
|---|---|---|---|
| 2,780,918 | 2/1957 | Rohrscheib | 60/468 X |
| 3,864,911 | 2/1975 | Gellatly et al. | 60/430 |

*Primary Examiner*—Edgar W. Geoghegan
*Attorney, Agent, or Firm*—Wegner, Stellman, McCord, Wiles & Wood

[57] ABSTRACT

An energy conserving hydraulic system for a lift truck or the like including a hydraulic tilt cylinder and a hydraulic lift cylinder subject to varying load requirements, manually operable valves for controlling the cylinders, a first, high volume hydraulic pump, a second, low volume hydraulic pump, a reversible, bidirectional DC motor for simultaneously driving both the pumps, and a piping system connecting the pumps to the valves such that for one direction of drive of the motor, the first pump will deliver a high volume of hydraulic fluid to the valve for operation of the lift cylinder, and for the other direction of drive of the motor, the first pump will be unloaded. A conduit is also arranged such that for the other direction of drive, the second pump will deliver a low volume of hydraulic fluid to the valve for directing the same to the tilt cylinder. An electrical direction control for controlling the direction of drive is responsive to the valves.

11 Claims, 2 Drawing Figures

HYDRAULIC SYSTEM FOR ELECTRIC LIFT TRUCKS

BACKGROUND OF THE INVENTION

This invention relates to hydraulic systems wherein hydraulic work performing means are subject to varying load requirements. More particularly, the invention relates to energy conservation in such systems. The invention is particularly well suited for, but not limited to, use in electric lift trucks.

Prior art of possible relevance includes U.S. Letters Pat. No. 3,864,911 issued Feb. 11, 1975 to Gellatly et al.

Air pollution problems have resulted in a reawakening of interest in electrically driven vehicles by reason of their avoidance of emission problems. Successful operation of such vehicles, however, has been hindered to a great degree by energy considerations. As is well known, such vehicles operate off of direct current supplied by batteries carried with the vehicle and their range of use is dependent upon the energy storage capacity of the batteries which, in turn, is dependent upon the number and type of batteries which the vehicle may carry.

In certain applications for electric vehicles, duties other than propulsion are required of the electrical system. For example, in electric lift trucks, ultimately the energy provided by the batteries is employed to raise loads carried by a fork or the like on the vehicle mast as well as to tilt the mast at various times during operation. In general, such lift trucks employ hydraulic cylinders for effecting the lift and tilt operations and the cylinders are provided with hydraulic fluid under pressure from a pump driven by an electric motor.

In most operations of lift trucks, considerably greater energy is expended during a lifting operation than is expended when the mast is merely being tilted. Thus, when such a lift truck is provided with a pump having a sufficient capacity to properly operate the lift cylinder, the use of the output of such a pump for tilting operations represents a waste of the capacity thereof and a concomitant waste of the battery energy.

SUMMARY OF THE INVENTION

It is the principal object of the invention to provide a new and improved hydraulic system. More specifically, it is an object of the invention to provide an energy conserving system that is particularly suited for use where varying load requirements are encountered as, for example, in lift trucks.

An exemplary embodiment of the invention achieves the foregoing object in a hydraulic system including a hydraulic work performing mechanism of the type having varying load requirements. Valves are provided for controlling the mechanism and a first, high volume, hydraulic pump is employed. A second, low volume, hydraulic pump is also included and there is provided a reversible, bidirectional prime mover for simultaneously driving both of the pumps. Conduit means are provided for connecting the pumps to the valve means such that for one direction of drive of the prime mover, the first pump will deliver a high volume of hydraulic fluid to the valve means for direction to the work performing elements and for the other direction of drive of the prime mover, the first pump will be unloaded and the second pump will deliver a low volume of hydraulic fluid to the valves. Thus, the high volume pump is employed for high loads and is unloaded when low loads are encountered which are handled by the output of the second pump. Means are also provided for selecting the direction of drive of the prime mover.

When the system is employed in a lift truck, the prime mover typically will be a direct current electric motor run by batteries carried by the lift truck and the work performing mechanism will include a tilt cylinder and a lift cylinder, requiring low and high volumes of hydraulic fluid respectively.

According to one embodiment of the invention, for high volume requirements, the second pump is unloaded while the first pump is operative.

According to another embodiment, for high volume requirements, both pumps are operative and the high volume pump is unloaded only when low volumes are required.

Other objects and advantages will become apparent from the following specification taken in connection with the accompanying drawings.

DESCRIPTION OF THE PREFERRED EMBODIMENTS

Figure 1:
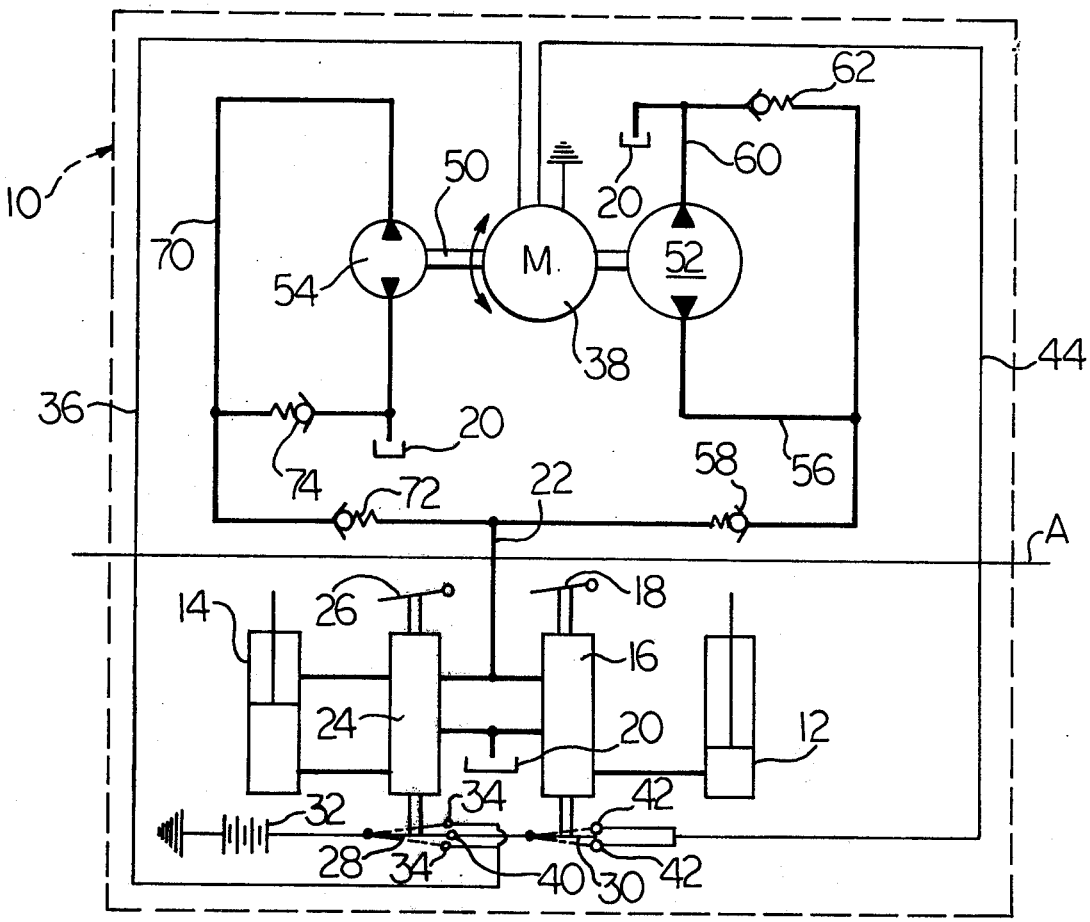
FIG. 1 is a schematic of one embodiment of a hydraulic system and attendant electrical controls embodying the invention.

One embodiment of a hydraulic system made according to the invention is illustrated in FIG. 1 in connection with a lift truck, generally designated 10, and schematically indicated by the dotted line. The lift truck 10 may have any desired construction but, as is well known, will include a lift cylinder 12 which typically will be a single-acting hydraulic cylinder and operative to raise a load carried on a platform, fork, or the like, when hydraulic fluid under pressure is applied thereto. The truck 10 will also include a tilt cylinder 14 by which the mast, which carries the fork, may be tilted fore and aft, as desired, for the usual purposes. The cylinder 14 will typically be a double-acting cylinder so that positive movement of the mast in either direction can be attained.

The lift cylinder 12 is controlled by a manually operated valve 16 having an operator 18 which is shiftable between three positions in a conventional fashion. One such position will be a neutral position whereat hydraulic fluid is neither directed to nor relieved from the cylinder 12. In another position, fluid within the cylinder 12 may be directed to a hydraulic reservoir 20. This corresponds to a command to lower the load, the weight of the load acting downwardly on the piston of the cylinder 12 to force the exit of fluid therefrom.

In the remaining position of the valve, fluid under pressure from a line 22 may be directed to the cylinder 12 to cause the same to lift the load.

The tilt cylinder 14 is controlled by a manually operable valve 24 having a manual actuator 26. The valve 24 will also be a three-position valve, with one position being a neutral position wherein fluid communication between the cylinder 14 and either the line 22 or the reservoir 20 is broken. In another position, the lower end of the cylinder 14 will be connected to the reservoir 20 while the upper end will be connected to the supply line 22. In the third position, the valve 24 will connect the lower end of the cylinder to the supply line 22 and the upper end of the cylinder to the reservoir 20. The last two positions of the valve 24 are employed to tilt the mast fore and aft.

The valves 16 and 24 are coupled to electrical switches 28 and 30 and the solid line positions of each indicate the configuration of the switches when both valves are in their neutral position. Dotted line positions of the switches indicate the configuration of the switches when their associated valve is in either of its active positions.

The switch 28 is connected to one side of a battery 32, the other side of which is connected to ground. The battery 32 is carried by the lift truck and provides the energy for driving the same as well as for accomplishing the lift and tilting functions. When necessary, the battery 32 is recharged.

Two terminals 34 of the switch 28 which are contacted when the valve 24 is in one of its active positions (the switch 28 is closed through only one of the terminals 34 at any given time) are connected in common to a line 36 which extends to a direct current, reversible, electric motor 38. The motor 38 also includes a connection to ground as indicated and the arrangement is such that when the switch 28 is closed through either of the contacts 34, the motor 38 will be energized and will provide a rotary output in one of the two directions of rotation of which it is capable.

When the valve 24 is in its neutral position, the switch 28 is closed through a contact 40 which is connected to the common side of the switch 30. The switch 30, when the valve 16 is in its neutral position, is open, but when the valve 16 is shifted to either of its active positions, will close through one of two contacts 42 which are connected in common to a line 44 which in turn extends to motor 38. When power is applied to the motor 38 through the line 44, the output thereof will be in the opposite direction.

It will be noted that the only time that the motor 38 may be energized via the line 44 is when the switch 28 is closed through its contact 40 corresponding to a neutral position of the valve 24. Thus, it is impossible to energize the motor 38 through both the lines 36 and 44 at the same time, which energization would cause internal damage thereto.

The motor 38 has its output shaft 50 connected to a first, bidirectional, hydraulic pump 52, which pump provides a sufficiently large capacity as to efficiently operate the lift cylinder 12. The shaft 50 is also connected to a second, bi-directional hydraulic pump 54 of relatively low capacity, which capacity is ideally suited for efficient operation of the tilt cylinder 14.

The pump 52 has a hydraulic line 56 extending from one side thereof through a check valve 58 to the supply line 22 and for one direction of energization of the motor 38, fluid under pressure will be pumped through the line 56 and the check valve 58 to the supply line 22. Fluid to be pressurized by the pump 52 is drawn from a line 60 connected to the reservoir 20 as schematically illustrated.

The first pump 52 is provided with a bypass line including a check valve 62. When fluid under pressure is being directed through the line 56, the check valve 62 will remain closed to preclude such fluid from being directed to the reservoir 20.

For the other direction of rotation of the motor 38, the pump 52 will pump fluid through the line 60 to the reservoir 20 and will acquire makeup fluid from such line through the check valve 62 which will then open to relieve back pressure and prevent cavitation. As a consequence, when the pump 52 is directing fluid under pressure through the line 60, the pump 52 will essentially be unloaded since only minor fluid flow friction within the conduit will be encountered.

The pump 54 includes an output line 70 which is also connected to the supply line 22 through a check valve 72 similar to the check valve 58. A bypass line including a check valve 74 is also included and serves the same function as that employed in connection with the pump 52. However, the bypass lines are arranged with respect to their associated pumps so that when the pump 52 is applying fluid under pressure to the supply line 22, which will correspond to one direction of rotation of the motor 38, the pump 54 will be unloaded by reason of the presence of the bypass line. For the opposite direction of rotation of the motor 38, when the pump 52 is unloaded, the pump 54 will be directing fluid under pressure to the supply line 22.

The arrangement of the bypass lines and the electrical components of the circuit is such that when the valve 24 is operated to actuate the tilt cylinder, the motor 38 will have its output going in a particular direction which will result in the unloading of the pump 52 and the loading of the pump 54. Conversely, when the valve 24 is in its neutral position and the valve 16 is shifted to an active position to require the lift cylinder 12 to be extended, the pump 54 will be unloaded, while the pump 52 will be loaded to provide the higher volume of hydraulic fluid necessary to perform the operation.

It will be observed that, if desired, the lift cylinder can be actuated when the tilt cylinder is actuated but only with a low volume of hydraulic fluid from the pump 54 since, as mentioned previously, the motor 38 cannot be caused to provide a directional output that would load the pump 52 when the valve 24 is in either of its active positions.

Figure 2:
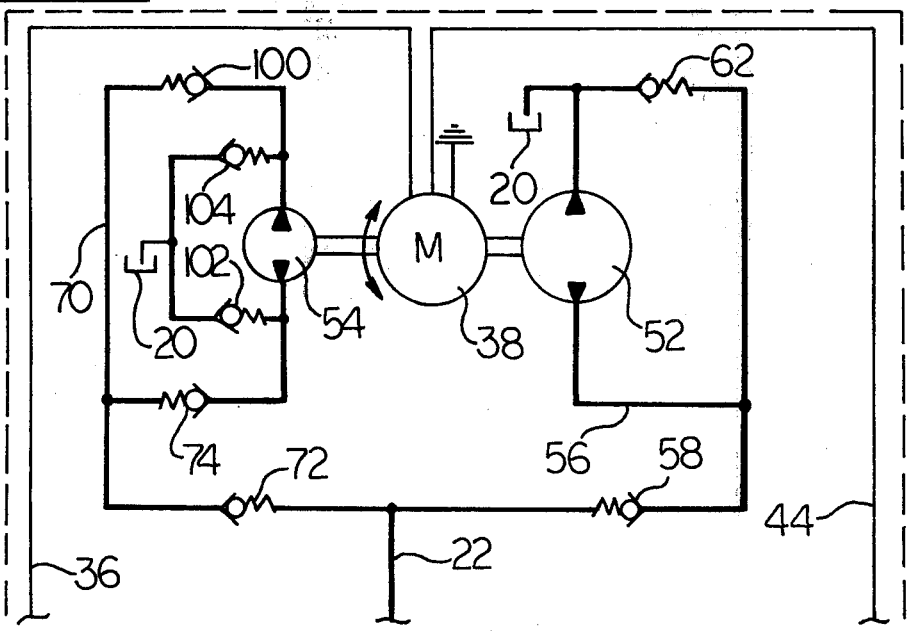
FIG. 2 is a fragmentary schematic of a modified embodiment of the invention.

FIG. 2 illustrates a modified embodiment of the invention wherein the low capacity pump 54 is continuously loaded while the large capacity pump 52 is loaded only when the lift cylinder is to be actuated and the valve 16 is shifted from its neutral position. Before proceeding with a full description of the embodiment of FIG. 2, it should be observed that all components illustrated in FIG. 1 below the line A are employed in the same relation to the supply line 22 and the electrical lines 36 and 44 as illustrated in FIG. 1. Additionally, where like parts are employed, like reference numerals are utilized.

The essential difference between the two embodiments is the provision in the embodiment of FIG. 2 of a check valve 100 in the line 70 and check valves 102 and 104 connected to opposite sides of the pump 54 and extending to the reservoir 20. When the pump 54 is being driven in one direction by the motor 38, fluid under pressure may be directed through the check valve 100 to the supply line 22. It cannot be directed to drain by reason of the check valve 104. However, fluid from the reservoir to be pressurized by the pump 54 can be admitted to the other side thereof via the check valve 102.

When the pump 54 is driven in the opposite direction, fluid under pressure will pass through the check valve 74 to the supply line 22. At this time, fluid under pressure cannot be directed to the reservoir by reason of the presence of the valve 102. On the other hand, makeup fluid is directed to the other side of the pump 54 through the check valve 104.

The embodiment illustrated in FIG. 2 possesses the same advantage as that shown in FIG. 1 in terms of the disablement of the large volume, high load pump 52 when relatively low loads encountered in tilting are all that need be dealt with. Where high loads are required, the embodiment of FIG. 2 makes the output of both pumps 52 and 54 available. This can be an advantage where higher volumes of fluid are required than would be provided by the pump 52 in the embodiment of FIG. 1 or, in the alternative, provides the advantage of permitting the use of a smaller capacity high volume pump so long as the combined capacities of the pumps 52 and 54 of the FIG. 2 embodiment equal that of the pump 52 in the FIG. 1 embodiment. Consequently, initial cost of the system can be cut by reason of the ability to employ a smaller, high capacity pump.

What is claimed is:

1. An energy conserving hydraulic system, comprising:

a hydraulic, work performing mechanism of the type having varying load requirements;

valve means for controlling said mechanism;

a first high volume hydraulic pump;

a second low volume hydraulic pump;

a reversible, bidirectional prime mover for simultaneously driving both said pumps;

conduit means connecting said pumps to said valve means such that for one direction of drive of said prime mover, said first pump will deliver a high volume of hydraulic fluid to said valve means and for the other direction of drive said first pump will be unloaded and said second pump will deliver a low volume of hydraulic fluid to said valve means; and means for selecting the direction of drive of said prime mover.

2. The hydraulic system of claim 1 wherein said prime mover is a direct current electric motor.

3. The hydraulic system of claim 2 wherein said hydraulic mechanism comprises a tilt cylinder and a lift cylinder for a lift truck and said valve means comprise a first control valve for said tilt cylinder and a second control valve for said lift cylinder, said selecting means including electrical switches for causing said motor to drive in said one direction when said second control valve is operated to direct hydraulic fluid to said lift cylinder and for causing said motor to drive in said other direction when said first valve is operated to direct hydraulic fluid to said tilt cylinder.

4. The hydraulic system of claim 1 wherein said conduit means is constructed and arranged so that for said one direction of drive, said second pump will deliver a low volume of hydraulic fluid to said valve means simultaneously with said first pump.

5. The hydraulic system of claim 1 wherein said conduit means is constructed and arranged so that for said one direction of drive, said second pump will be unloaded.

6. The hydraulic system of claim 1 wherein said selecting means is coupled with said valve means.

7. An energy conserving hydraulic system for an electric lift truck or the like, comprising:

a direct current, reversible motor;

a first, high volume hydraulic pump connected to said motor to be driven thereby;

a second, low volume hydraulic pump connected to said motor to be driven thereby;

first and second, unidirectional, fluid bypass circuits for said first and second pumps respectively, said first bypass circuit being operative for one direction of drive of said motor to unload said first pump, said second bypass circuit being operative for the other direction of drive of said motor to unload said second pump;

a first hydraulic work performing device requiring high volumes of hydraulic fluid;

a second hydraulic work performing device requiring low volumes of hydraulic fluid;

valve means selectively operable to direct hydraulic fluid from said pumps to said first and second work performing devices; and a direction control circuit for said motor and responsive to said valve means for causing said motor to drive in said one direction when said valve means has been operated to direct fluid to said second work performing device and for causing said motor to drive in said other direction when said valve means has been operated to direct fluid to said first work performing device.

8. The hydraulic system of claim 7 wherein said direction control circuit includes means for precluding said motor from driving in said other direction when said valve means has been operated to direct fluid to said second work performing device.

9. The hydraulic system of claim 7 wherein said first work performing device is a lift cylinder for a lift truck and said second work performing device is a tilt cylinder for a lift truck.

10. An energy conserving hydraulic system for an electric lift truck or the like, comprising:

a direct current, reversible motor;

a first, high volume hydraulic pump connected to said motor to be driven thereby;

a second low volume hydraulic pump connected to said motor to be driven thereby;

a unidirectional, fluid bypass circuit for said first pump operative for one direction of drive of said motor to unload said first pump;

a first hydraulic work performing device requiring high volumes of hydraulic fluid;

a second hydraulic work performing device requiring low volumes of hydraulic fluid;

valve means selectively operable to direct hydraulic fluid from said pumps to said first and second work performing devices; and a direction control circuit for said motor and responsive to said valve means for causing said motor to drive in said one direction when said valve means has been operated to direct fluid to said second work performing device and for causing said motor to drive in said other direction when said valve means has been operated to direct fluid to said first work performing device or operated to direct fluid to both said work performing devices.

11. The hydraulic system of claim 10 wherein said first work performing device is a lift cylinder for a lift truck and said second work performing device is a tilt cylinder for a lift truck.

* * * * *